US007682296B2

(12) United States Patent
Brown

(10) Patent No.: US 7,682,296 B2
(45) Date of Patent: Mar. 23, 2010

(54) AERO HYDRAULIC EXERCISE AND PHYSICAL THERAPY EQUIPMENT AND METHOD

(75) Inventor: Louis S. Brown, Pensacola, FL (US)

(73) Assignee: Brown & Company of Pensacola, Inc., Pensacola, FL (US)

( * ) Notice: Subject to any disclaimer, the term of this patent is extended or adjusted under 35 U.S.C. 154(b) by 3 days.

(21) Appl. No.: 12/505,554

(22) Filed: Jul. 20, 2009

(65) Prior Publication Data

US 2009/0280963 A1 Nov. 12, 2009

Related U.S. Application Data

(62) Division of application No. 11/359,942, filed on Feb. 22, 2006, now abandoned.

(51) Int. Cl.
*A63B 21/008* (2006.01)
*A63B 69/16* (2006.01)
*A63B 22/12* (2006.01)

(52) U.S. Cl. ..... 482/113; 482/62

(58) Field of Classification Search ..... 482/51, 482/57–59, 62–63, 79–80, 111–113; 601/23, 601/33–36; *A63B 22/06, 69/16, 21/008, A63B 22/12*

See application file for complete search history.

(56) References Cited

U.S. PATENT DOCUMENTS 445,726 A 2/1891 Coop
457,602 A 8/1891 Coop
3,531,112 A 9/1970 Gibbs
3,587,319 A 6/1971 Andrews
3,802,781 A 4/1974 Good, Jr.
3,911,907 A 10/1975 Smith, Jr.
4,129,297 A 12/1978 Dolan
4,191,370 A 3/1980 Meyer et al.
4,397,462 A 8/1983 Wilmarth
4,406,454 A 9/1983 Dean
4,471,957 A 9/1984 Engelitcheff, Jr.
4,575,076 A 3/1986 Reichert et al.
4,684,125 A 8/1987 Lantz
4,805,900 A 2/1989 Sapp
4,880,230 A 11/1989 Cook
4,883,268 A 11/1989 Salkind
4,934,695 A 6/1990 Wolff
4,969,643 A 11/1990 Kroeker et al.
5,002,272 A 3/1991 Hofmeister
5,037,088 A 8/1991 Bernstein
5,114,389 A 5/1992 Brentham
5,246,410 A 9/1993 Fun
5,256,118 A * 10/1993 Chen ..... 482/53
5,267,923 A * 12/1993 Piaget et al. ..... 482/53
5,284,461 A 2/1994 Wilkinson et al.

(Continued)

*Primary Examiner*—Loan H Thanh
*Assistant Examiner*—Oren Ginsberg
(74) *Attorney, Agent, or Firm*—Dennis G. LaPointe

(57) ABSTRACT

An air spring is used as a resistance device in exercise equipment having a lever arm for exercising arms and legs. In one embodiment, the equipment can be adapted to be used as a stair stepper. In another, it can be adapted to be used on a table surface for exercising hands, wrists and forearms. In still another embodiment, it can incorporate a bike pedal assembly to simultaneously aerobically exercise the legs and arms. The equipment includes resistance level regulating components and a visual indicator using a gauge or similar device to monitor resistance levels.

8 Claims, 13 Drawing Sheets

U.S. PATENT DOCUMENTS 5,346,444 A 9/1994 Hsieh
5,441,466 A 8/1995 Piaget et al.
5,527,251 A 6/1996 Davis
5,545,111 A 8/1996 Wang et al.
5,605,524 A 2/1997 Husted
5,632,711 A 5/1997 Hwang
5,702,327 A 12/1997 Fullbright
5,762,587 A 6/1998 Dalebout et al.
5,788,617 A 8/1998 Paris
5,807,210 A 9/1998 Devlin
5,842,958 A 12/1998 Rufa
5,947,873 A 9/1999 Sands et al.
6,705,975 B2 3/2004 Kuo
7,160,229 B2 1/2007 Park
2008/0161733 A1* 7/2008 Einav et al. ..... 601/34

* cited by examiner

AERO HYDRAULIC EXERCISE AND PHYSICAL THERAPY EQUIPMENT AND METHOD

RELATED APPLICATION

This application is a divisional application of U.S. patent application Ser. No. 11/359,942 filed Feb. 22, 2006.

FIELD OF THE INVENTION

The present invention is directed to a method and apparatus for physical exercise using air spring technology.

BACKGROUND OF THE INVENTION

Exercise equipment, in general, is known in the art. Air springs are also known in the art. An air spring is an elastomeric bellows having end closures that allow for mounting on vehicles and industrial equipment. The bellows contains a fluid such as air, some other gas or a liquid, usually under pressure.

BRIEF SUMMARY OF THE INVENTION

The present invention is directed to physical therapy equipment based upon an air spring acting as a flexure joint, and methods of exercise utilizing the air spring. Using such a flexure joint will allow deflections in the range of nearly 90 degrees and a rotational deflection direction of a full 360 degrees.

In one embodiment the exercise device is constructed from an air spring or referred to herein as a flexure joint device, a lever arm attached to an upper portion of the flexure joint device, a rigid unsprung frame member attached to a portion of the outer surface (lower side) of the flexure joint device to prevent motion of the portion of the flexure joint device attached to the rigid member when the lever arm is moved, and a human body engaging member attached to the lever arm, whereby the lever arm can be moved with resistance by the human body engaging member in any direction away from an in rest position of the lever arm. The resistance is adjustable and can be selectively controlled by the user by adjusting the pressure within the flexure joint device.

Air springs or flexure joint devices suitable for use in this invention are commercially available from Companies such as the Firestone Industrial Products Company. This company calls such devices AIRSTROKE® actuators and AIR-MOUNT® isolators. Although such devices are adapted to be used in pneumatic systems, they can be adapted to be used in hydraulic and aero-hydraulic systems. The elastomeric bladder is typically sandwiched between an upper and lower covers, which make the elastomeric bellows or bladder airtight. These covers are sometimes called by the industry bead plates. They can be designed with flanges as means for mounting to brackets or solid surfaces. In the present invention, it is anticipated that the air springs assembly be adapted with means to attach its bottom to a solid platform, floor or other surface such as a table (rigid unsprung frame member described above); and the upper part be adapted with means for engaging a lever arm as described above. Typically, the upper part includes an inlet port for the air or hydraulic fluid medium.

The human body engaging member can be a hand grip, a foot-engaging member, such as a foot pad or any other body engaging member. The hand grip can be a T-bar configuration or cross-shaped along the lever arm containing two hand grips. The body-engaging member can be secured/strapped to work out specific body parts and allow work-out while pushing or pulling against the air spring assembly.

The human body-engaging member can be resilient or gyroscopic. The gyroscopic hand or foot feature interfaces to reduce strain and transmit force with natural body movements.

The exercise device preferably contains pressure-regulating means for adjusting pressure in the flexure joint device. This is usually done by those skilled in the art by the use of a regulating valve and relief valve. The fluid medium filling the flexure joint device can be air for pneumatic control or hydraulic fluid for hydraulic control or other similar fluid media suitable for using under pressure and suitable for varying by the use of regulators/valves, including the combination of air and hydraulic components/features.

The base member of the flexure joint device can be mounted on a vertical surface. In this embodiment, the mounting can be on a wall, a post or on a frame system that allows for height (vertical) adjustment or lateral adjustment and/or combinations of such adjustment to suit the height of the person using the equipment and/or the standing position on a floor or platform of the user, as well as the part of the body engaging member being exercised. Such adjustments can also accommodate persons in wheelchairs, sitting, standing, lying down on side or back. The apparatus can be mounted to hospital beds, home beds, wheelchairs and home furniture.

In the above description and as further described below, the flexure joint device provides a great advantage in allowing for exercise motion in any direction, including performing rotational actions, side to front, front to side, up and down, inward, etc. For example, the apparatus could incorporate both linear and flexure joint movement to simulate human movement. This would help with occupational therapy such as lifting a box over your head.

Such adjustable means are known in the art. For example, the flexure joint device and its lever arm can moved along a track and tightened when moved to a desired location or located with a quick-release pin type system where pins are inserted in apertures or friction lock tubing. It is preferred that the equipment's flexure joint device be designed such that a user can adjust the resistance of the apparatus by adjusting the pressure. A gauge can be provided and connected to the pressurizing lines, with a user friendly interface indicating levels of resistance as is the case with many aerobic exercise machines today. The gauge can be located so to be in plain view of the user. The resistance adjustment controls should also be located so as to be readily adjusted by the user of the equipment. The levels can be visualized digitally or by a needle scale type of arrangement. User interface can include a computer interface so a physical therapist or other attendant, for example, can control the workout program. For example, air springs could have pressure transducers, electronic pressure regulator, and rotational flexure transducers to interface with a computer. This would allow real-time monitoring of the air spring pressure, deflection direction, and amount of deflection. Amount of force exerted on the apparatus could also be determined by the air spring pressure differential produced when the air spring deflects and compresses the air. Mechanical stops could be used to limit the travel of the flexure member so that the patient's range of motion would be controlled so as not to re-injure or aggravate an injury. A computer rehabilitation program could be used by the physical therapist or other attendant to monitor and/or modify the characteristics of the flexure member.

The exercise device can have a bicycle type pedal mounted on the lever arm. In this embodiment, the lever arm can be resistance adjusted through the flexure joint device and the pedals can also have means for adjusting the pedaling resistance. In this embodiment, the present invention becomes two exercising devices for exercising both arms and/or both legs. Seating means are provided either independent of the invention so the bicycle embodiment can be used or the bottom of the flexure joint device can be mounted on a surface common to the mounting of the seat means. Effectively, the user sits on a bicycle-like seat and is able to exercise by pedaling while at the same time moving the arm with typically two hand grips inward and outward. Of course, the individual features can be used separately. That is, the legs can be exercised by the pedaling action and the arms can be exercised by the flexure of the flexure joint device, combination or individually. In addition, in the bicycle-like seat embodiment or when a person is in a wheelchair, the person can pull up and lift his body of the seat/chair using the flexure apparatus, lean forward, left and right, against the flexure apparatus, and push and pull on the apparatus for exercising.

In another embodiment, legs and hips could be exercised by a stair stepping action provided by the invention.

In another embodiment, the T-bar or generally T-shaped hand grips can themselves be adapted to include a flexure joint device. In this case the rigid frame member may be a relative long frame member extending from a wall or floor or it may be a very short base member attached to a table top surface or the like or the wall. This embodiment is great for exercising the shoulders, forearms, wrists and hands.

Another embodiment is the use of two side by side flexure joint devices, each having on its top a generally planar and elongate foot standing surface that extends a pre-determined lever arm distance (for example, 12 to 24 inches away from the flexure joint device), and each generally parallel to each other. A person can stand on each lever arm and use the apparatus as a step exerciser. It is preferable if handrails for balance be available to the user.

The combination can have a foot positioning surface for exercise of the feet and legs and to ensure that a person's foot does not slide off the surface. These surface forms are typical of stair stepping exercise equipment used in gyms.

In other embodiments, the flexure apparatus can be configured so that the bottom of an air spring is mounted to the floor or stationary base and a small platform is mounted to the top of the air spring. This would be used to help with balancing and will strengthen hip flexors. Air pressure would be regulated so that higher air pressure stiffens the platform and limits range-of-motion and the opposite for lower air pressures. A safety hand rail should preferably be built around the balancing plate.

Further, specific flexure devices can be configured for activities such as: arm wrestling, strengthening baseball and football throwing arms, strengthening all joints, recovery from operations such as knee or elbow surgery, tendonitis, tennis elbow, and similar conditions.

DETAILED DESCRIPTION OF THE INVENTION

Figure 1:
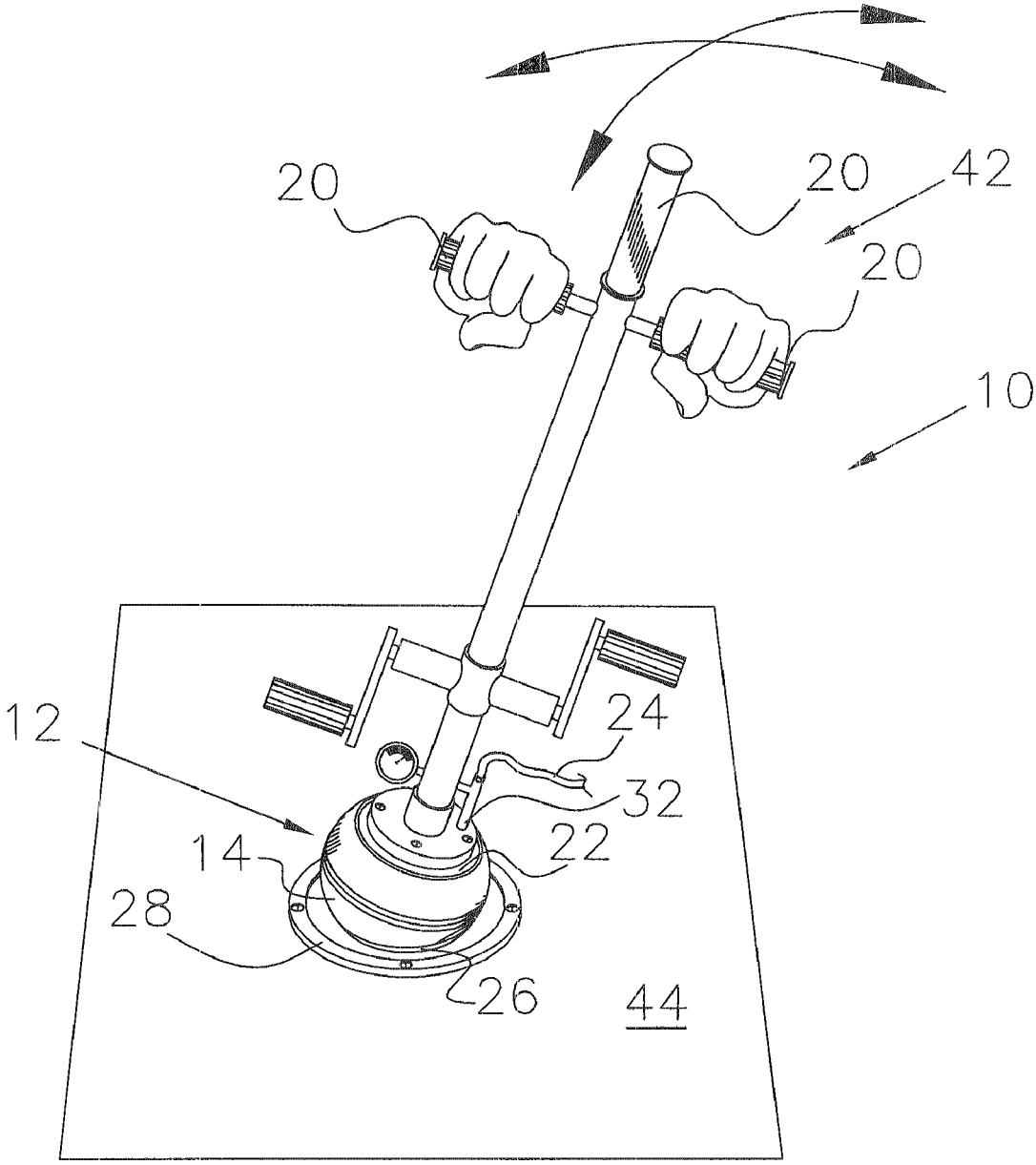
FIG. 1 is a perspective conceptual view of one embodiment of the present invention with the lever arm in use.
Figure 2:
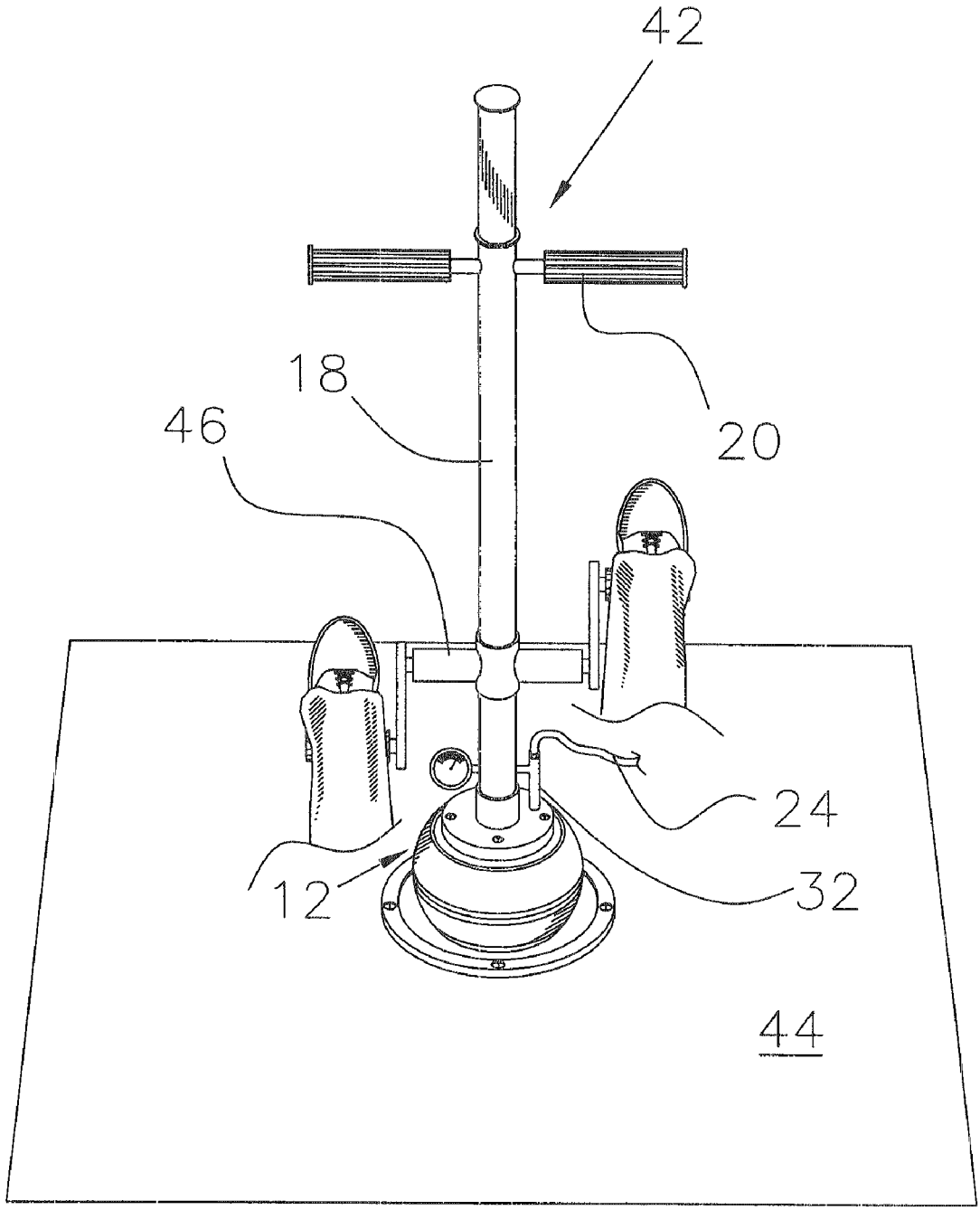
FIG. 2 is a conceptual depiction of the embodiment of FIG. 1 with a pedal assembly being used.

Turning now to FIGS. 1-11, one or more embodiments of the invention 10 are generally depicted. There is shown a flexure joint assembly 12 (also referred to herein by its industrial generic name as an air spring or air spring assembly), having an inflatable bellows or bladder 14, filled with a fluid 16 such as air or hydraulic fluid. To the upper part of the assembly 12, is attached a lever arm 18 having a hand grip 20. The lever arm 18 is attached to the assembly's 12 upper plate 22, which covers the bellows 14. Pressure is introduced into bellows 14 via conduit means 24 for supplying the fluid 16 to and for pressurizing the flexure joint assembly 12.

The lower portion or plate 26 of the flexure joint assembly 12 is attached to a rigid unsprung base member 28. By "unsprung" is meant that the air spring assembly 12 does not impart any springing action to base member 28. Base member 28 merely holds air spring assembly in place when lever arm 18 is moved to exercise a user. The base member 28 attached to the flexure joint assembly 12 can be mounted on a vertical surface 30. In this embodiment, the mounting can be on a wall 30*a* or on a frame system 30*b* (examples only) or other working/anchoring member, including a post, that allows for height (vertical) adjustment or lateral adjustment and/or combinations of such adjustment to suit the height of the person using the equipment and/or the standing position on a floor or platform of the user, as well as the part of the body engaging member being exercised. Of course, frame system 30*b* could be independent or itself mounted to a wall surface 30*a* or other working/anchoring member.

The flexure joint assembly 12 has a fluid inlet port 32, which is in fluid communication with the bellows 14, the conduit means and a fluid supply source 34, which typically an air compressor system or a hydraulic pump system.

Figure 3:
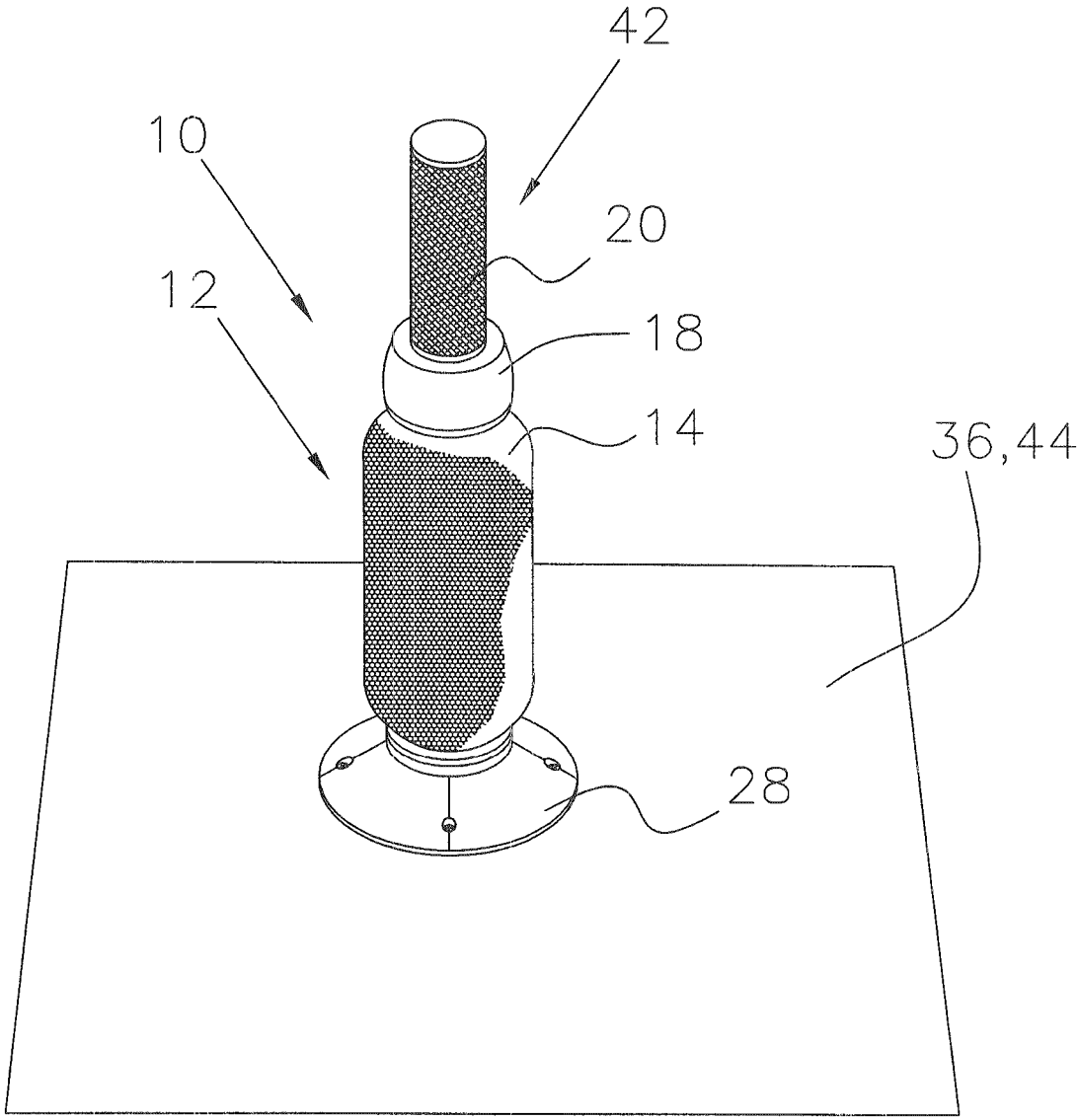
FIG. 3 is a conceptual depiction of another embodiment of the invention where the lever arm is relatively short for exercise of wrist and forearms.
Figure 4:
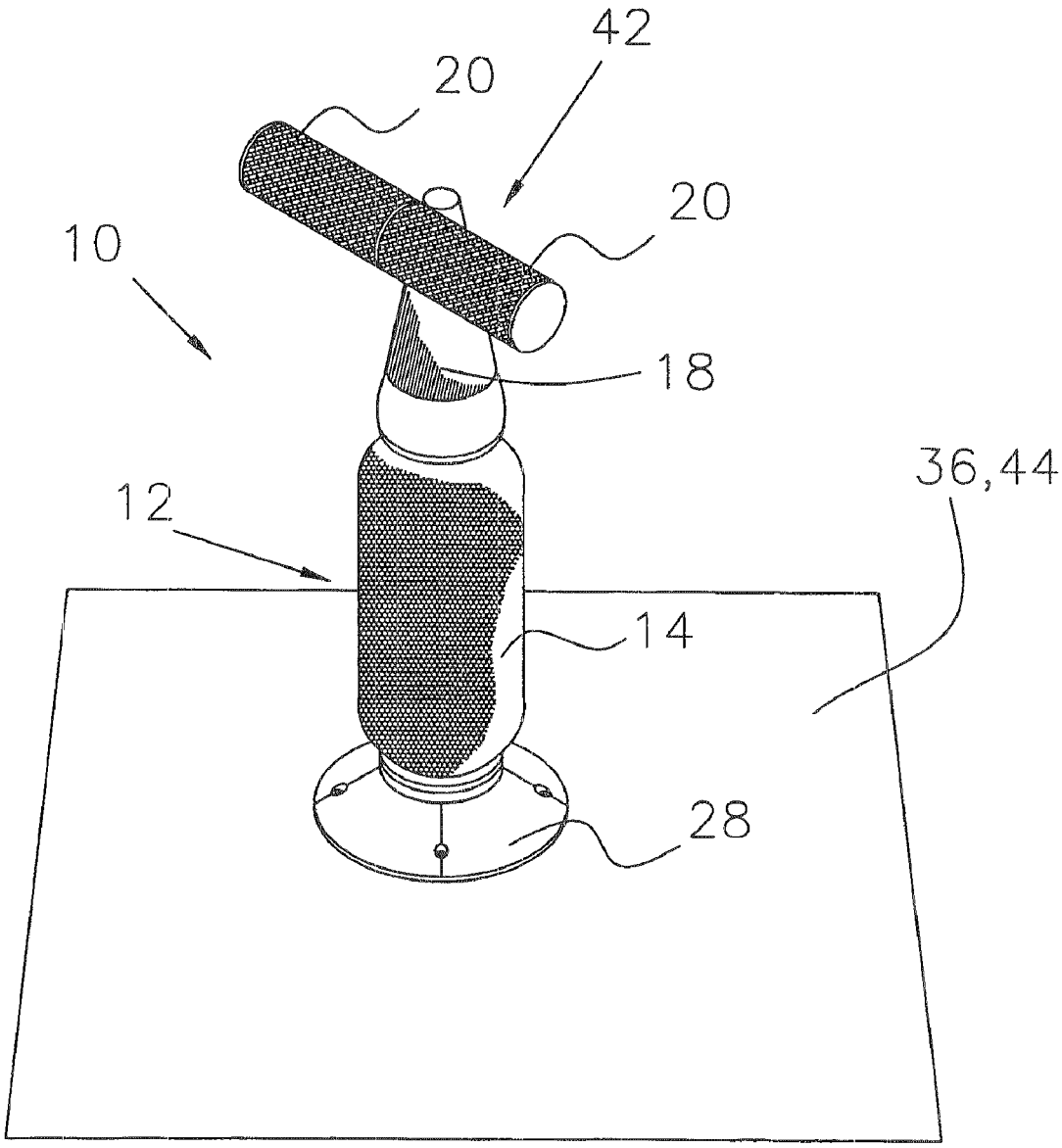
FIG. 4 is a conceptual depiction of an embodiment similar to that of FIG. 3, except that a T-shaped handle is provided for gripping by both hands.
Figure 5:
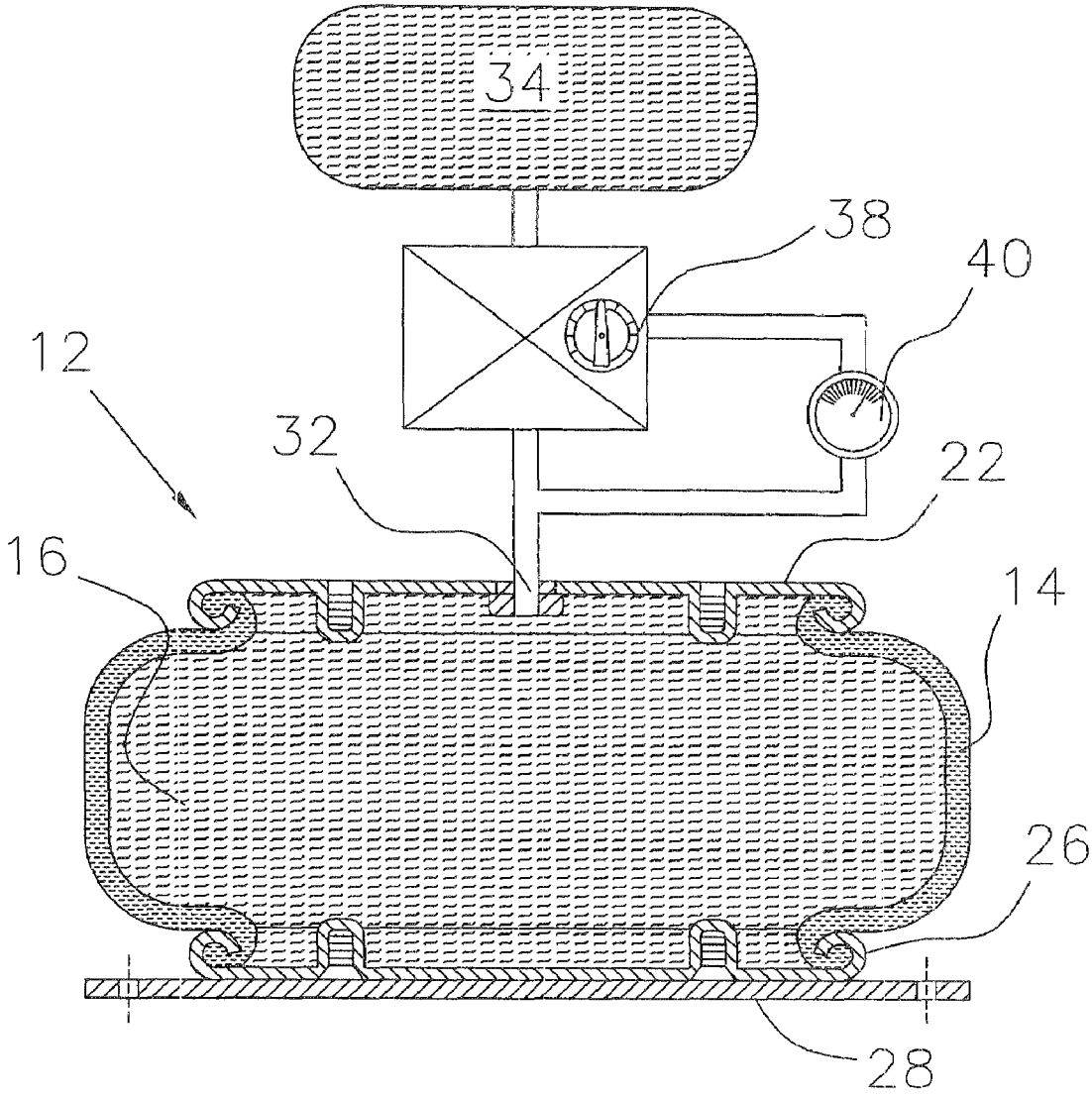
FIG. 5 is a conceptual partial cross-section depiction of a bellows system where the fluid medium is hydraulic fluid filled from a hydraulic pump source.
Figure 6:
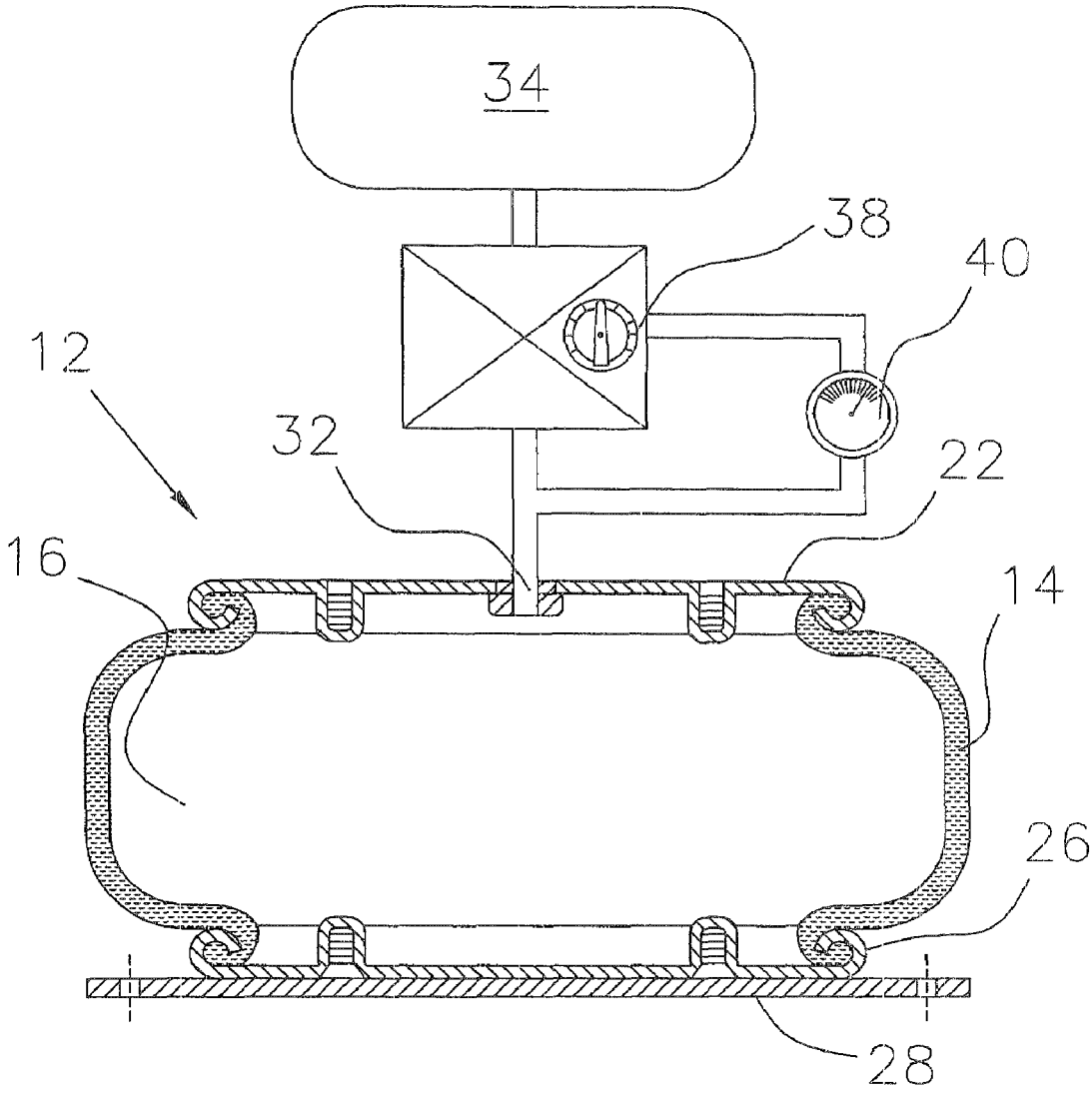
FIG. 6 is a conceptual partial cross-section depiction of a bellows system where the fluid medium is air filled from an air compressor source.
Figure 7:
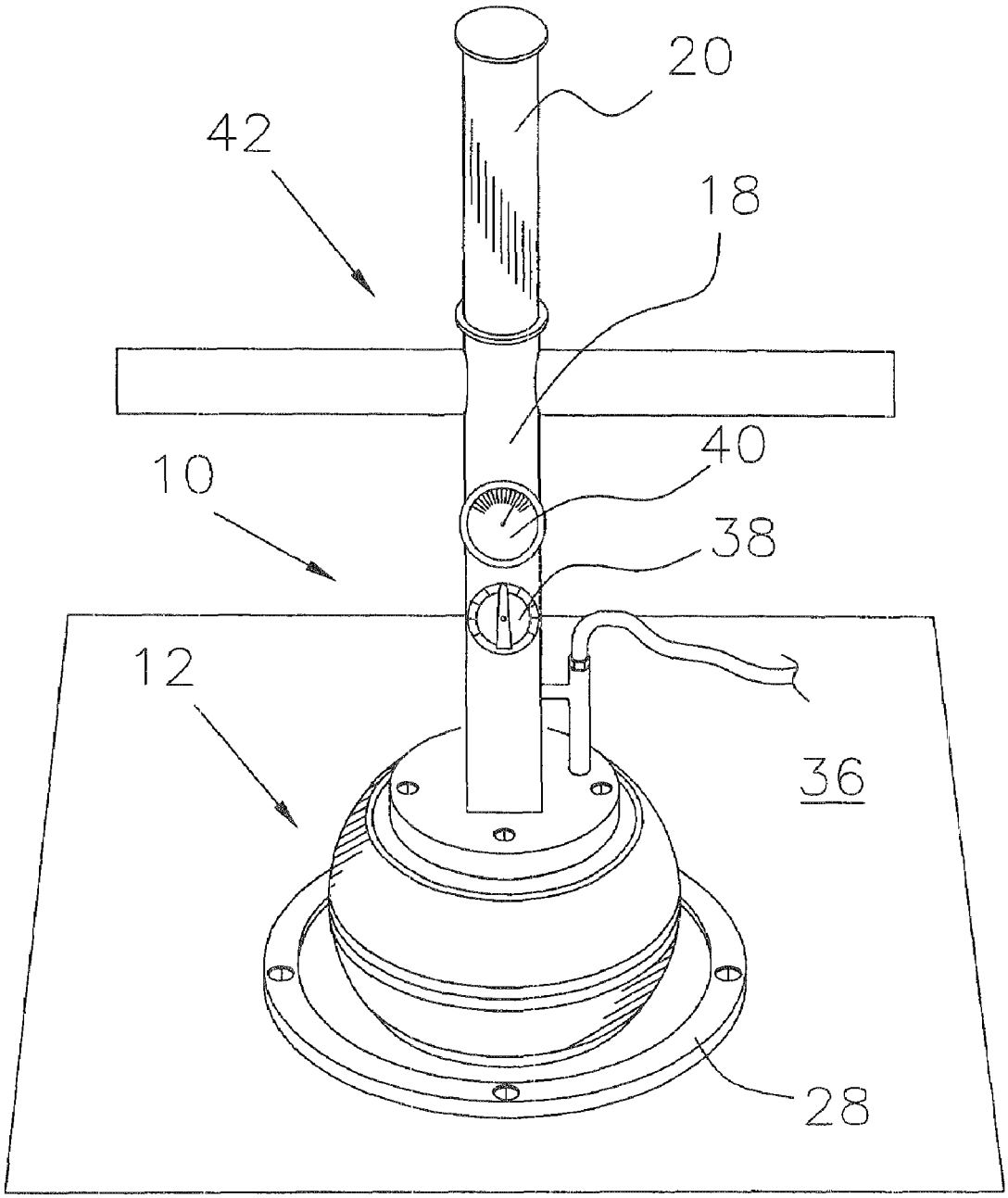
FIG. 7 is a conceptual depiction of an embodiment similar to FIG. 1, except the lever arm is shorter and the invention is mounted on a table or elevated surface.
Figure 8:
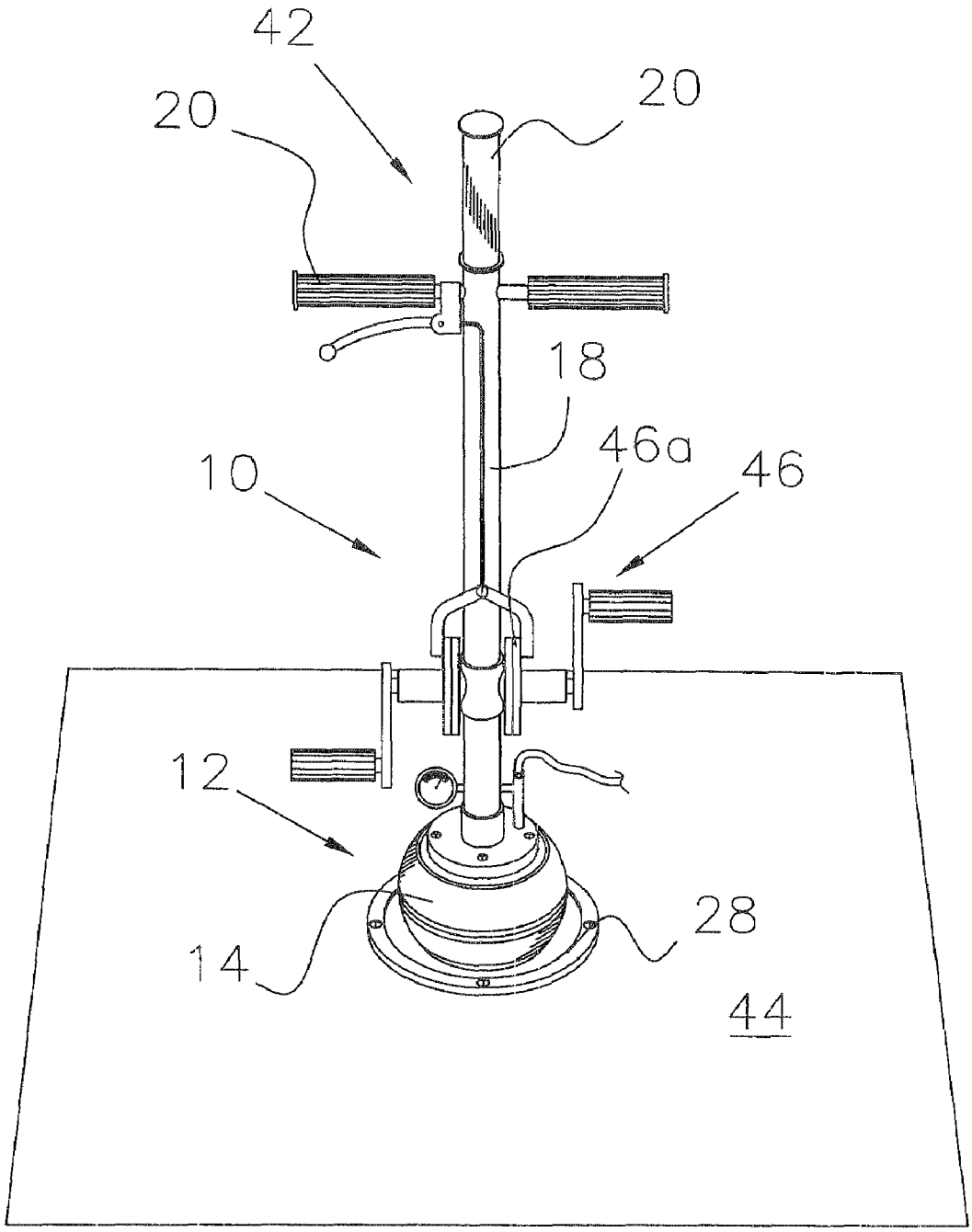
FIG. 8 is a conceptual depiction of an embodiment similar to FIG. 1, further depicting an example of how resistance can be applied to the pedaling action.
Figure 9A:
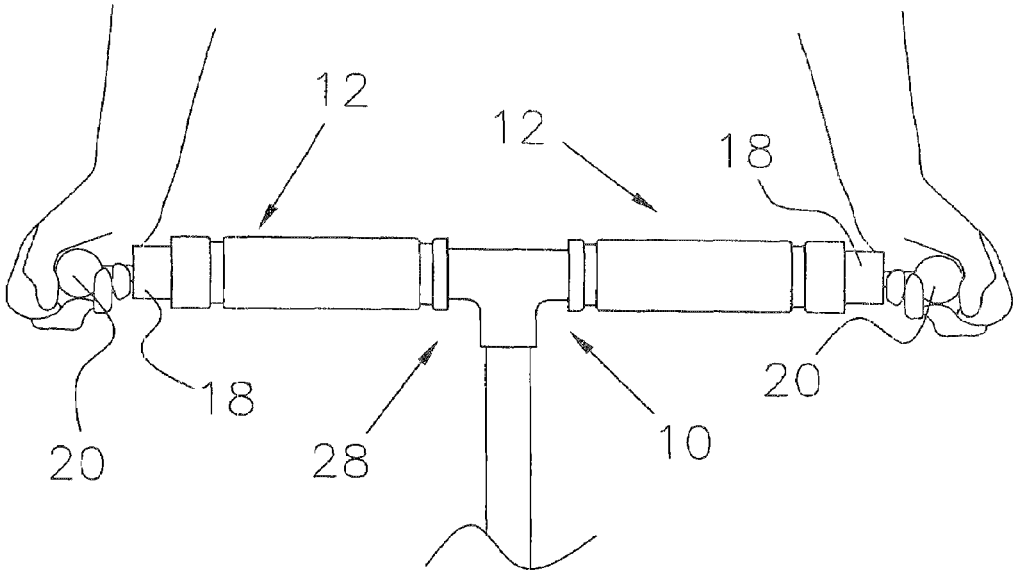
FIGS. 9*a* and 9*b* are conceptual depiction of the invention where the rigid member to which the flexure joint assembly is attached is a T-shaped structural member to facilitate exercising with both hands at the same time.
Figure 9B:
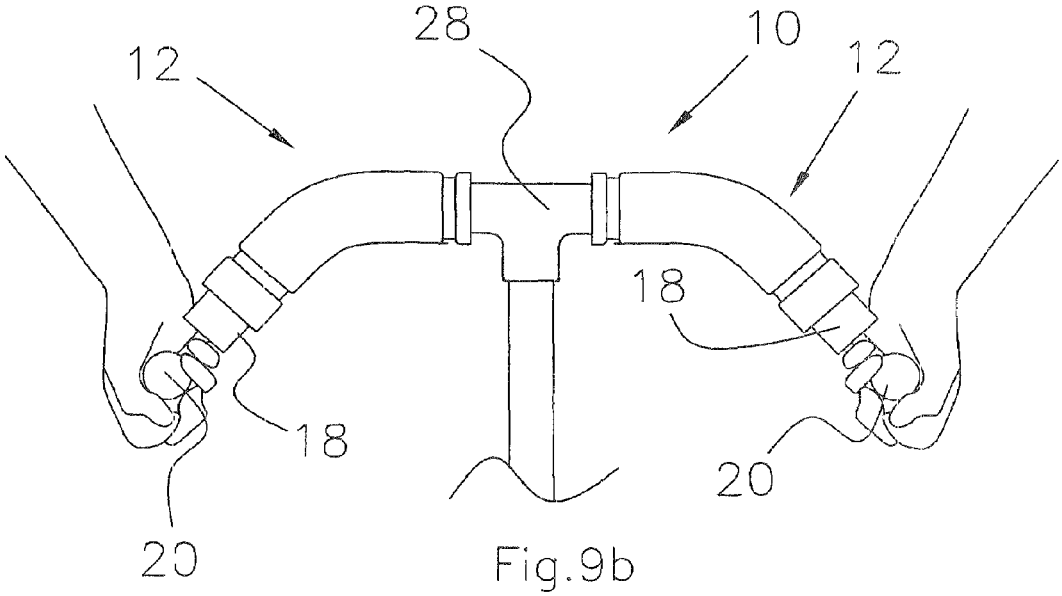
Figure 10:
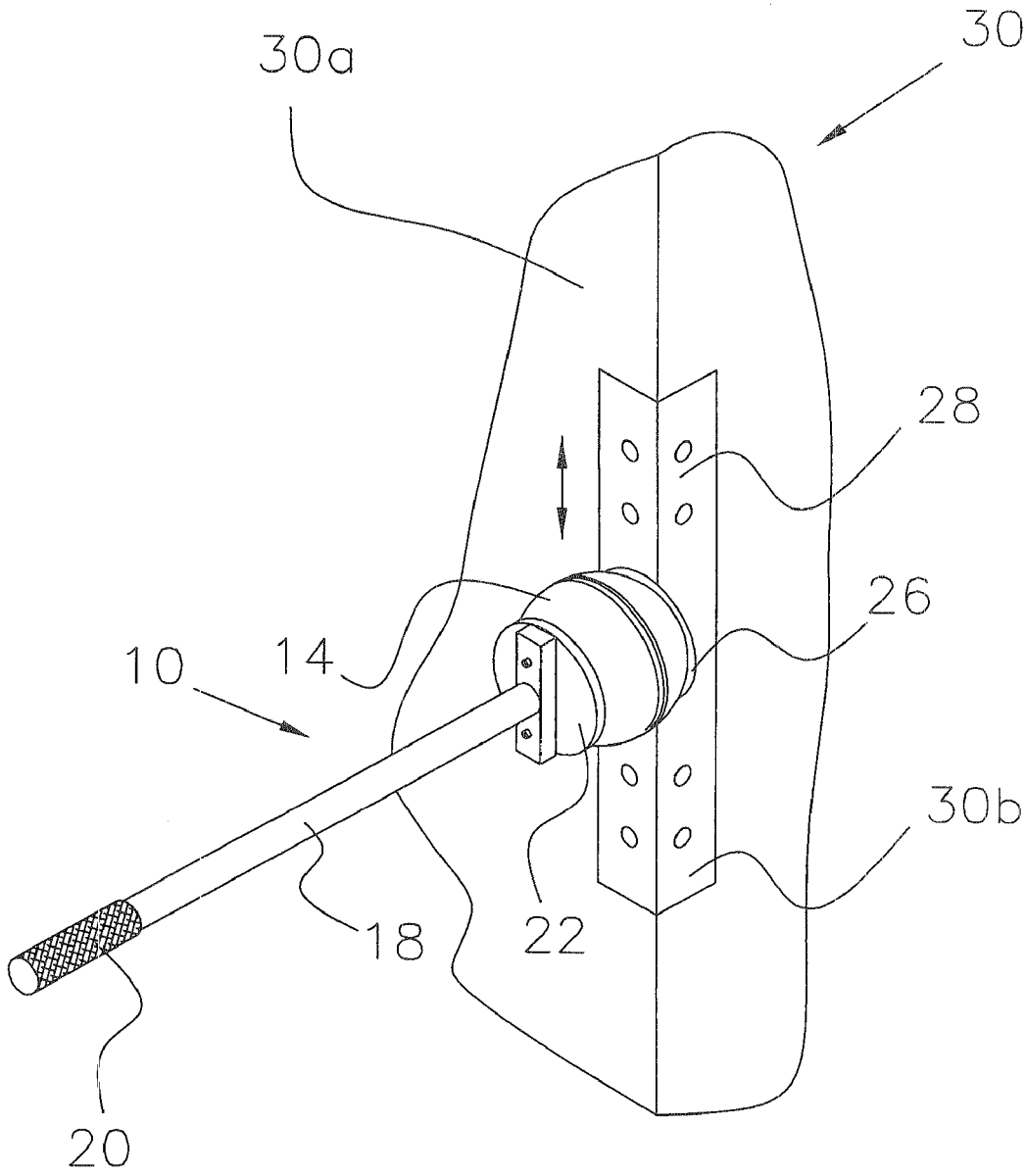
FIG. 10 is a conceptual depiction of an example of mounting the invention on a wall surface with elevation adjustment possibilities.
Figure 11:
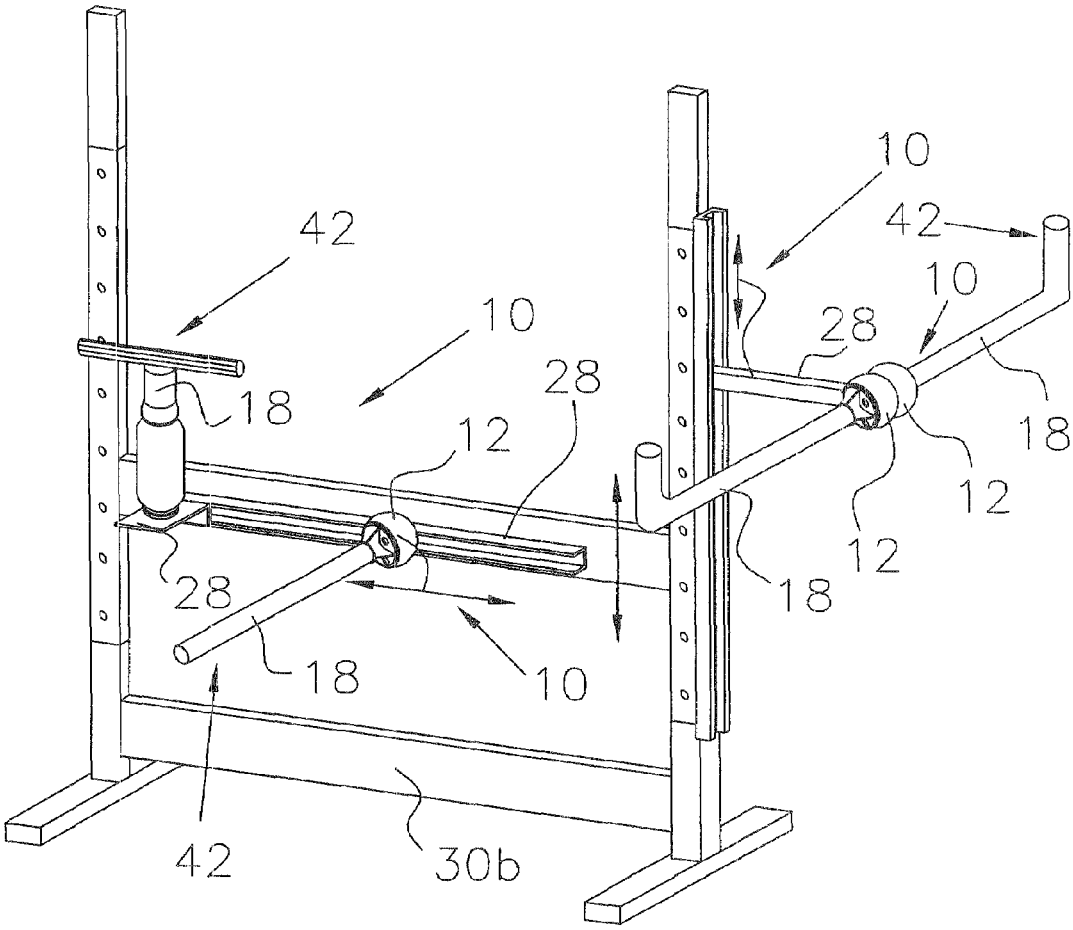
FIG. 11 is a conceptual depiction of various embodiments of the invention being applied to a universal gym type frame system.

FIGS. 3, 4 and 7 depict examples where the invention 10 is shown on an elevated surface or table surface 36. Means for regulating the pressure to adjust resistance is conceptually depicted as 38 in FIGS. 5 and 6. Conceptually, the means 38 for regulating the pressure is a control device that can be located so as to be used by an attendant, such as a therapist, either adjacent to the invention or remotely from an attendant working station. This includes setting up means 38 to be computer controlled. This conceptual regulating means applies to all embodiments shown in all the drawings, although not shown in FIGS. 3 and 4 and only partially shown in FIG. 7. The amount of pressure, which should be presented on the gauge face in user friendly terms such as resistance levels 1-10, is shown conceptually as gauge 40. Of course, the gauge face could also be presented in an actual pounds per square inch (psi), foot-pounds, or a similar analogous scale that imparts some meaning to the person using the equipment according to the embodiments of the invention, depending on the preference of the manufacture and the intended use of the invention. The levels can be visualized digitally or by a needle scale type of arrangement.

Handle means 42 at the upper end of the lever arm 18 are provided. The handle means 42 can provide for different types of hand grips 20. Typically hand grips 20 can be designed to be integral to the lever arm 18, or designed to cover a portion of the lever arm 18 such as a rubber or foam base hand grip. The lever arm's 18 opposite end is attached to flexure joint assembly 12, which in turn is mounted on table surface 36.

When mounted to a frame system 30*b*, the air spring assembly 12 and the frame system 30*b* (as well as the wall surface 30*a*) can be adapted so that assembly 12 is engaged to allow vertical and/or horizontal movement to suit the height or position of the user. This can be done by a number of ways known in the art, including the use of a track or channel with position tightening means such as bolts or quick release pins through mating apertures in the assembly lower portion 26 and the frame system 30*b* or even the wall surface 30*a*. Of course, another alternative is to have the bolts or release pins or other tightening means engage a channel in the wall or frame system under pressure. This allows the invention 10 to be moved up and down on a vertical wall surface 30, thereby allowing the height of lever arm 18 to be adjusted by the user.

The air spring assembly or flexure joint assembly 12 can be mounted or attached on a floor or other planar or generally horizontal platform 44. In an embodiment from the basic invention 10, a peddle assembly 46 is added to lever arm 18 to provide for exercise of the legs while exercising the arms with handle means 42 at the upper end of the lever arm 18. The resistance of pedal assembly 46 can also be adjustable using means known in the art, such as by using tension friction belt-type of systems as often used with exercise bikes or by using tubing with a smooth bore and a friction (phenolic) block inserted around the peddle shaft with an air inlet for pressurizing the back side of the block to obtain the desired resistance, or by using disc pads 46*a* with adjustable friction faces.

Various air spring assemblies can be employed in the practice of the present invention. Various lengths are available, as are assemblies having one or more convolutions. The style used will typically be a matter of design choice and aesthetic. For example, a more tubular or cylindrical shaped bellows may be desirable for the hand/wrist exercise embodiment, such as the bellows 14 shown in FIGS. 3, 4, 9*a* and 9*b*.

Figure 12:
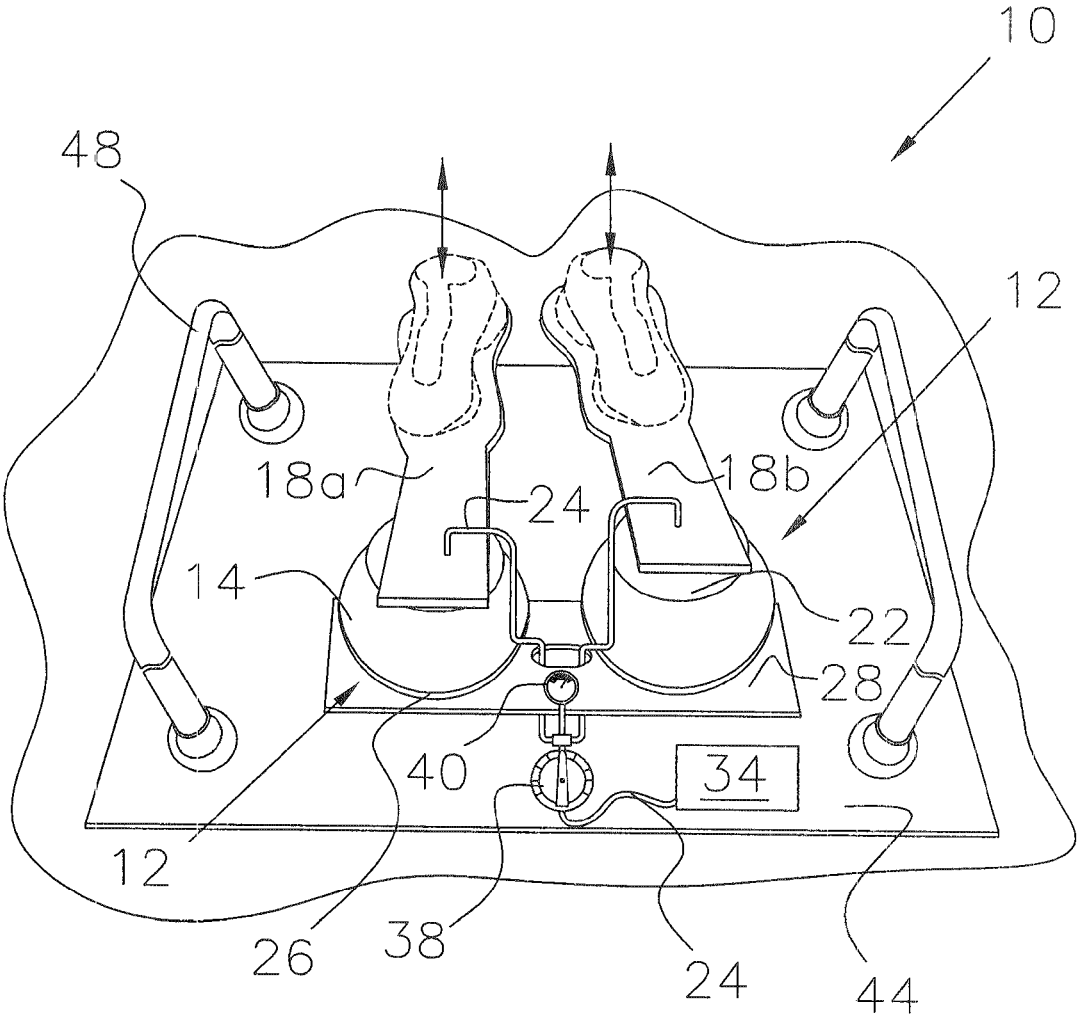
FIG. 12 is a conceptual depiction of another embodiment of the invention where two flexure joint assemblies are used with parallel lever arms adapted to support the feet of the person exercising with a common resistance regulating system and fluid source so that the invention can be used as a stair stepping exercise machine.

In another embodiment depicted in FIG. 12, two parallel air spring assemblies 12 are attached to a floor or horizontal platform 44. Generally flat lever arm 18*a*, 18*b*, each attached to one of the two air spring assemblies 12, extend relatively parallel to the plane of the floor a pre-determined distance from the flexure joint assembly 12. Typically, the lever arms 18*a*, 18*b* will be about 12 to 18 inches, but can be more or less. The user can exercise his or her feet and legs by moving them up and down while standing on lever arms 18*a*, 18*b* and using the embodiment as a stair stepper. A support frame for maintaining balance 48 should be used in conjunction with this embodiment of the invention 10, so that a user has something to hold on to while exercising.

Figure 13:
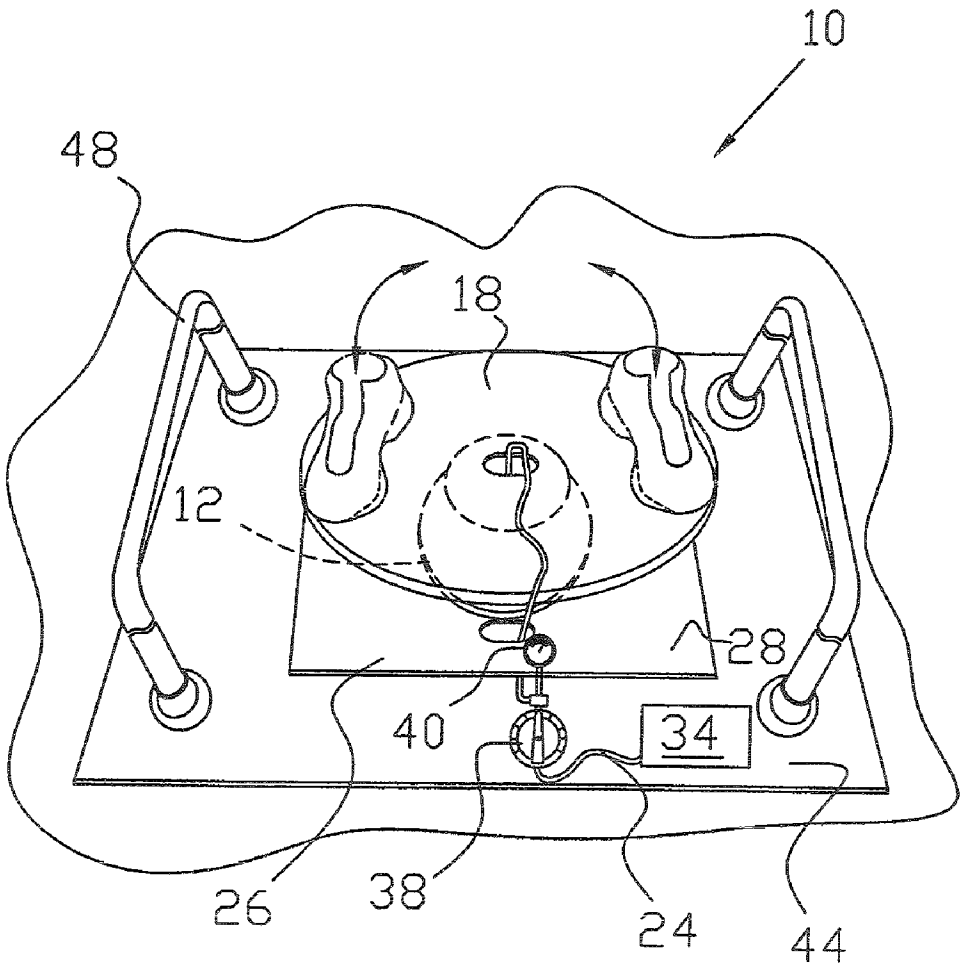
FIG. 13 is a conceptual depiction of another embodiment of the invention configured to be used as a balance exercise machine.

In another embodiment similar to that depicted in FIG. 12, FIG. 13 depicts a single air spring assembly 12, which is attached to a floor or platform 44 and the lever arm 18 is configured to serve as a human body engaging member so that a person exercising to enhance his or her balance can stand on the platform/lever arm portion. That is, the human body engaging member is in an overlying relationship to the closed upper portion of the flexure joint assembly and is configured so that a person exercising can stand on said human body engaging member for performing a balance exercise.

It should be understood that in the above mentioned embodiments, a vacuum cup with a 12 VDC portable air and vacuum compressor may be utilized.

It should also be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. An adjustably resistive pivoting flexure joint assembly comprising at least one airspring assembly having at least one elastomeric bellows intermediate portion with a closed lower plate portion and a closed upper plate portion, both said closed lower plate portion and said closed upper plate portion being mechanically clamped directly to respective ends of said at least one bellows intermediate portion, a lever arm having one end thereof attached directly to the closed upper plate portion of the flexure joint assembly, wherein said at least one elastomeric bellows serves as means for deflecting said lever arm at a variable resistance from a rest position to about 90° of deflection and rotating said lever arm at 360° of rotation, means for attaching said closed lower plate portion to a working/anchoring member or surface wherein said closed lower plate portion is configured to remain rigid and not move when said bellows, closed upper plate portion and lever arm move, a human interface member at a distal end of the lever arm, which is used by a person to exercise a desired body part, wherein a combination of said human interface member, said lever arm and said flexure joint assembly is configured to provide ergonomically resistive therapy for said desired body part;

a bicycle type pedal assembly mounted on the lever arm; and means for adjustably and selectively pressurizing the flexure joint assembly, including pressure regulating means for selecting a desired resistance to be applied to said person's desired body part for a selected pressure in said flexible joint assembly and for making adjustments to said resistance by adjusting said pressure in said flexible joint assembly, wherein said pressure regulating means is adjustable between 0-150 psig, and wherein said flexure joint assembly when pressurized at said selected desired resistance is configured to maintain a stored energy level such that an applied force must be exerted by said person to displace said lever arm from a neutral position and said force must be maintained to resist said lever arm's movement back to said neutral position.

2. The exercise device according to claim 1, wherein the bicycle type pedal assembly mounted on the lever arm includes means for adjusting a resistance of the pedaling action.

3. The exercise device according to claim 1, wherein the human interface member is a hand grip.

4. The exercise device of claim 3, wherein the hand grip is a generally T-shaped or cross-shaped member containing two hand grips.

5. The exercise device according to claim 1, wherein the flexure joint assembly contains a fluid, said fluid being air or hydraulic fluid or a combination of said air and hydraulic fluid.

6. The exercise device according to claim 5, wherein the means for adjustably pressurizing the flexure joint assembly further comprises:

an inlet port in one of the upper or lower portions of the flexure joint assembly, said inlet port serving as fluid inlet means to the interior of the elastomeric bellows;

a fluid supply source;

a fluid conduit in fluid communication between the fluid supply source and the elastomeric bellows; and pressure regulating means for operating the exercise device at a desired pressure within the flexure joint assembly.

7. The exercise device according to claim 6, wherein the pressure regulating means is selectively adjustable.

8. The exercise device according to claim 6, further comprising resistance level visual indicating means in mechanical communication with the fluid conduit and pressure regulating means for allowing a user or attendant to visually monitor or control the resistance level of the exercise.

* * * * *